US009180993B2

(12) United States Patent
Zhou et al.

(10) Patent No.: US 9,180,993 B2
(45) Date of Patent: Nov. 10, 2015

(54) FEEDING DEVICE

(75) Inventors: Jian-Bin Zhou, Shenzhen (CN); Che-Yu Chou, New Taipei (TW); Qun Huang, Shenzhen (CN); Tai-Shan Zhu, Shenzhen (CN); Tao Jiang, Shenzhen (CN); Wei-Wei Yu, Shenzhen (CN)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 746 days.

(21) Appl. No.: 13/482,365

(22) Filed: May 29, 2012

(65) Prior Publication Data

US 2013/0048147 A1 Feb. 28, 2013

(30) Foreign Application Priority Data

Aug. 22, 2011 (CN) ..... 2011 1 0241460

(51) Int. Cl.
*B65B 39/00* (2006.01)

(52) U.S. Cl.
CPC ..... *B65B 39/002* (2013.01); *B65B 39/003* (2013.01); *B65B 39/005* (2013.01); *B65B 2220/14* (2013.01)

(58) Field of Classification Search
CPC .... B65B 37/02; B65B 39/001; B65B 39/002; B65B 39/003; B65B 39/004; B65B 39/005; B65B 2220/14
USPC ..... 141/94, 98, 100, 103, 237, 242, 243, 141/286, 297, 305; 222/428, 429
See application file for complete search history.

(56) References Cited

U.S. PATENT DOCUMENTS

| | | | | | |
|---|---|---|---|---|---|
| 1,442,137 | A | * | 1/1923 | Falkiner | 222/429 |
| 1,487,468 | A | * | 3/1924 | Palmer | 222/129 |
| 2,893,602 | A | * | 7/1959 | Heacock et al. | 222/77 |
| 5,469,988 | A | * | 11/1995 | Huang | 222/1 |
| 5,651,401 | A | * | 7/1997 | Cados | 141/129 |

* cited by examiner

*Primary Examiner* — Timothy L Maust
*Assistant Examiner* — Timothy P Kelly
(74) *Attorney, Agent, or Firm* — Novak Druce Connolly Bove + Quigg LLP

(57) ABSTRACT

A feeding device includes a material pipe, a first container, a second container and a constant-length linkage mechanism. The material pipe is configured for feeding a first material. The first container is configured for receiving the first material and supplying a timed amount of the first material to a first material feed port. The second container is configured for storing a second material and supplying the second material to a second material feed port. The constant-length linkage mechanism is connected to the first container and the second container. When the first container is actually supplying the first material to the first material feed port, the constant-length linkage mechanism allows the second container to supply the second material to the second material feed port simultaneously.

15 Claims, 4 Drawing Sheets

FEEDING DEVICE

BACKGROUND

1. Technical Field

The present disclosure relates to a feeding device.

2. Description of Related Art

Feeding device is widely used in manufacturing industry. A variety of raw materials is added to the feeding device. When two different kinds of material are needed, two operators feed two kinds of material. As two operators feed two different kinds of material, operator errors may lead to loss of materials and a reduction in production efficiency.

What is needed, therefore, is a feeding device which can overcome the above-described limitations.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout the several views, and all the views are schematic.

DETAILED DESCRIPTION

Reference will be made to the drawings to describe various embodiments in detail.

Figure 1:
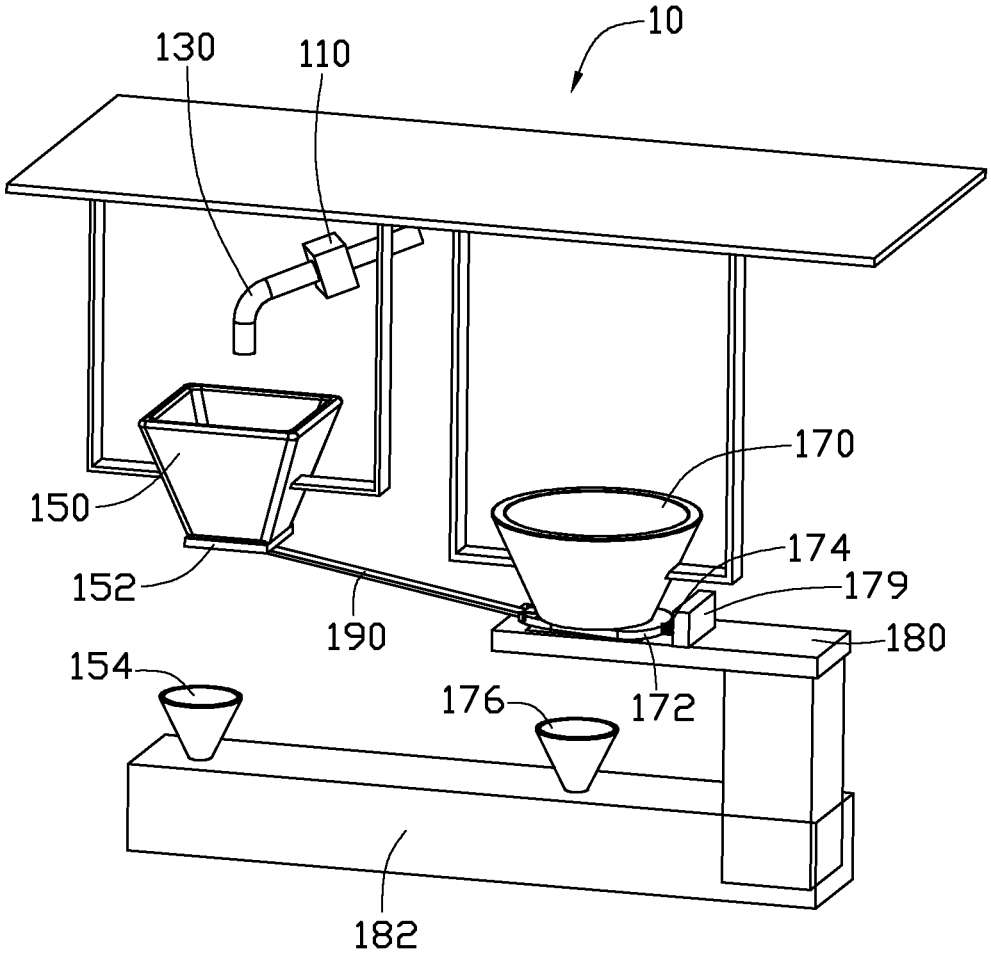
FIG. 1 is an isometric view of a feeding device according to one embodiment.
Figure 2:
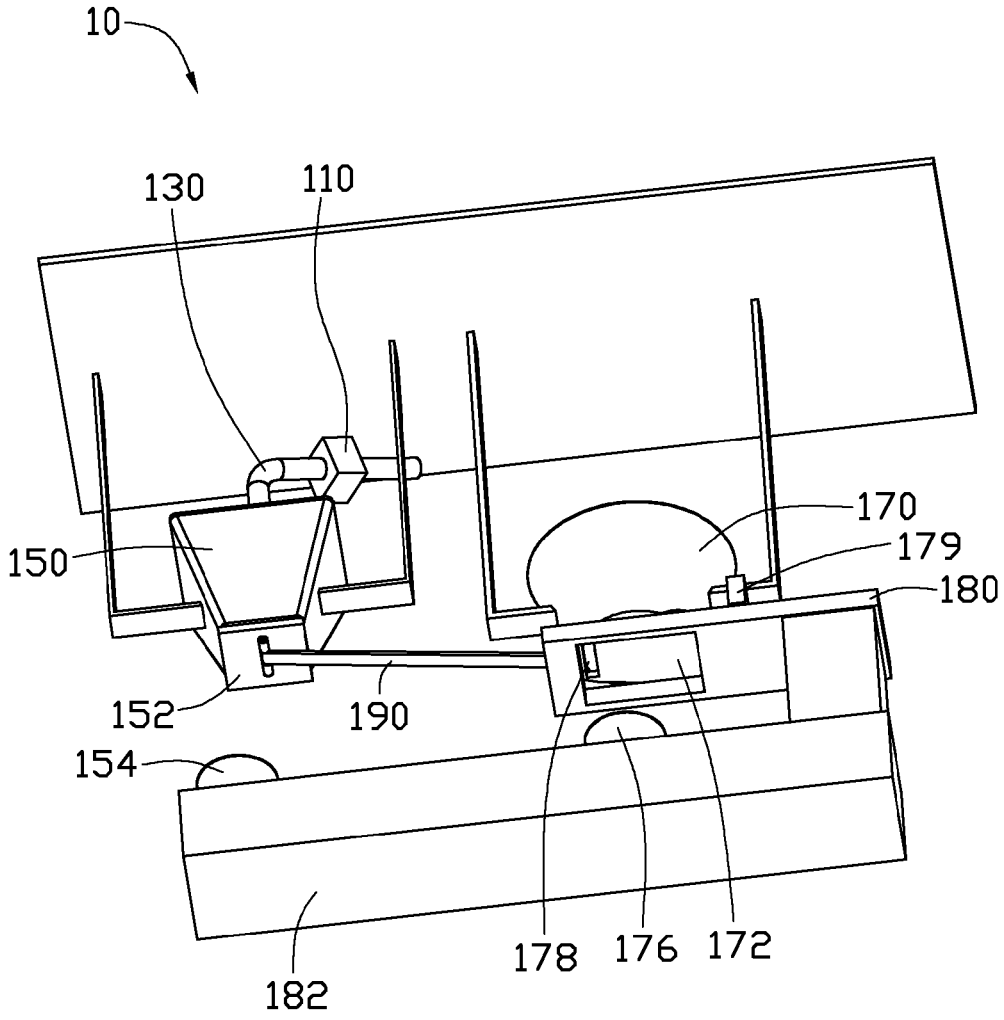
FIG. 2 is an isometric view of the feeding device of FIG. 1 from a different viewing angle.

Referring to FIG. 1 and FIG. 2, a feeding device 10 includes a timing switch 110, a material pipe 130, a first container 150, a first material feed port 154, a second container 170, a second material feed port 176, a constant-length linkage mechanism 190, and an automatic reset element 174. The first container 150 is configured for feeding a first material. The second container 170 is configured for storing a second material.

The material pipe 130 is above the first container 150. The material pipe 130 is configured for feeding the first material to the first container 150. The timing switch 110 is arranged on the material pipe 130 and configured for controlling the supply of the first material from the material pipe 130 to the first container 150 on a timed basis.

Figure 3:
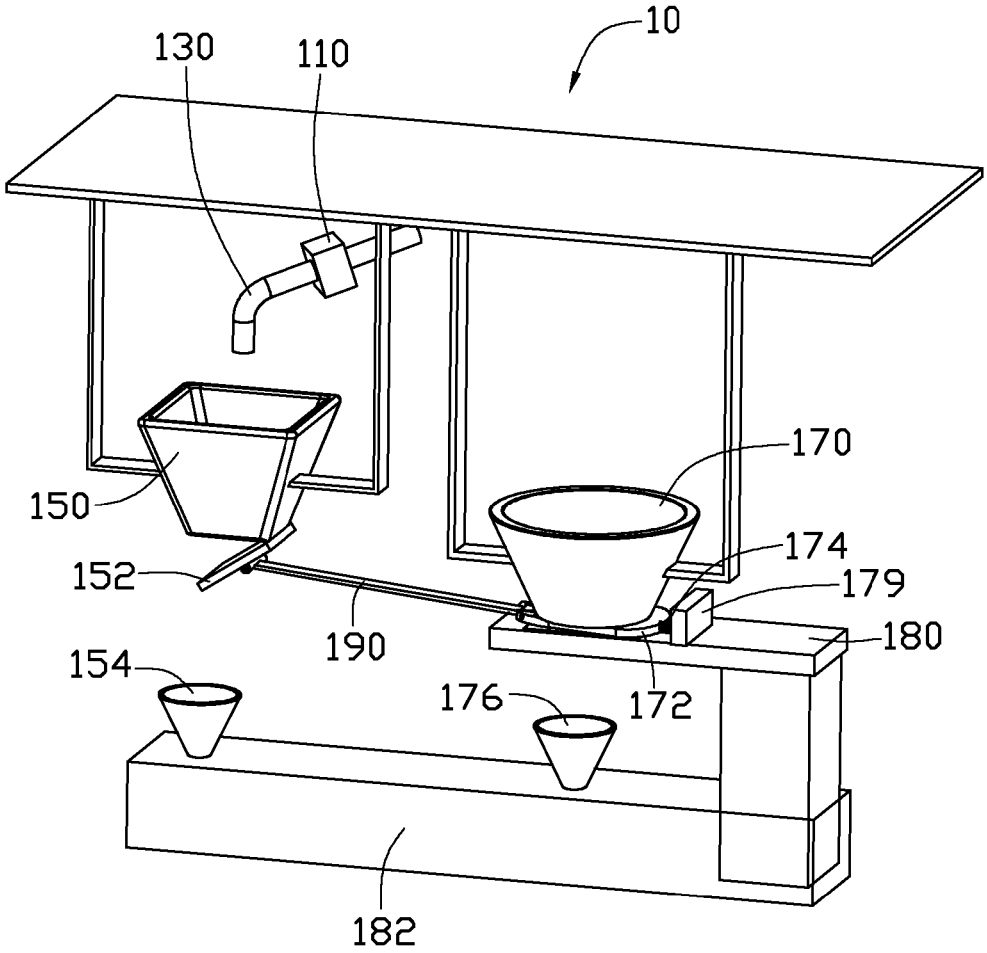
FIG. 3 is the feeding device of FIG. 1 in the feeding process.
Figure 4:
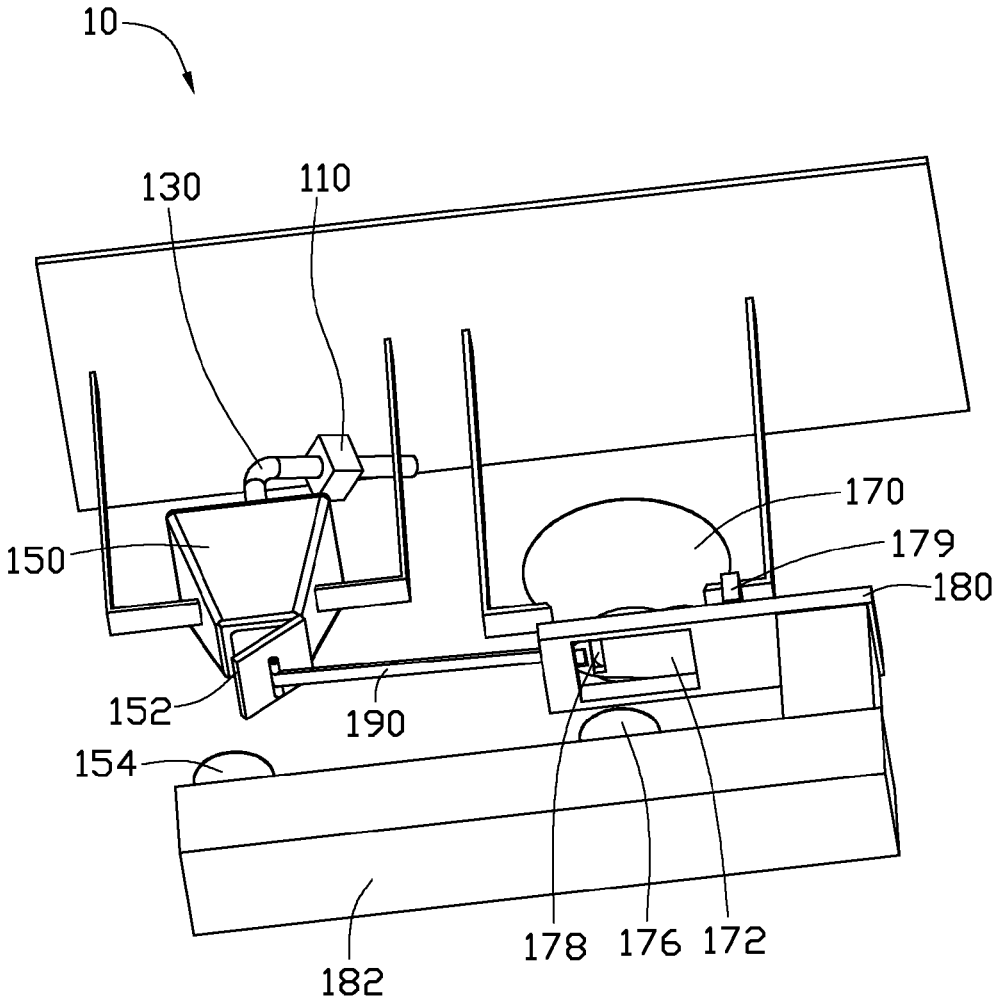
FIG. 4 is a lateral view of the feeding process state of FIG. 3.

In one embodiment, the first container 150 is a truncated inverted pyramid and is hollow and open at the top and the bottom. A first baffler 152 is rotatably connected to a bottom side of the first container 150 and functions as a movable bottom base of the first container 150. In detail, the first baffler 152 is square. One side of the first baffler 152 is hinged to a bottom side of the first container 150 and the first baffler 152 can rotate about the side of the baffler 152. The first material feed port 154 is arranged on a platform 182 below the first container 150. Referring to FIG. 3 and FIG. 4, when the first baffler 152 rotates to open the bottom of the first container 150, the first material in the first container 150 falls into the first material feed port 154 out of the bottom of the first container 150.

The second container 170 is a truncated inverted cone and hollow and open at the top and the bottom. A second baffler 172 is arranged at the base of the second container 170. The second baffler 172 can slide on a bracket 180 to function as a gate or valve at the bottom of the second container 170. A slit 178 is arranged on one end of the second baffler 172. In initial position, the slit 178 is located to one side of the open base of the second container 170, not underneath the open base. The second material feed port 176 is arranged on the platform 182 below the second container 170. Referring to FIG. 3 and FIG. 4, the second baffler 172 can slide along the bracket 180 from the initial position, the slit 178 moves so as to become aligned with the bottom of the second container 170, and thus the second material in the second container 170 is allowed to fall into the second material feed port 176 through the slit 178.

The constant-length linkage mechanism 190 connects to the first baffler 152 and the second baffler 172. In one embodiment, one end of the constant-length linkage mechanism 190 is hinged to the first baffler 152, the hinge is approximately in the middle of the side of the first baffler 152. The other end of the constant-length linkage mechanism 190 is hinged to the second baffler 172 near the slit 178 to push and pull on the second baffler 172. Referring to FIG. 3 and FIG. 4, when the first baffler 152 rotates, the constant-length linkage mechanism 190 pushes the second baffler 172 to slide along the bracket 180 from the initial position.

One end of the automatic reset element 174 is connected to the second baffler 152 opposite to the constant-length linkage mechanism 190. Other end of the automatic reset element 174 resists against a block 179 fixed on the bracket 180. The automatic reset element 174 is configured for resetting the second baffler 172 to the initial position after the first material in the first container has completely dropped into the first material feed port 154.

In one embodiment, the constant-length linkage mechanism 190 may be a connecting rod. The automatic reset element 174 may be a spring.

In operation, when the timing switch 110 is turned on, the material pipe 130 feeds the first material to the first container 150. The first container 150 stores a certain amount of the first material, as controlled by the timing switch 110, as gravity swings the first baffler 152 down to open the bottom of the first container 150, and thus the first material falls into the first material feed port 154.

At the same time, the second baffler 172 is pushed via the constant-length linkage mechanism 190 towards the block 179, until the slit 178 slides to be aligned with the open bottom of the second container 170. Thus, the second material stored in the second container 170 also falls into the second material feed port 176 through the slit 178. At this point, the automatic reset element 174 is held in compression by the second baffler 172 and the block 179.

When the timing switch 110 is turned off, the material pipe 130 stops feeding the first material. As the amount of first material in the first container 150 is reduced to the certain amount, the automatic reset element 174 forces the second baffler 172 to return to the initial position, and the second material can no longer fall into the second material feed port 176. At the same time, the second baffler 172 pushes the first baffler 152 back to close up the bottom entrance by way of the constant-length linkage mechanism 190, and thus the first material can no longer fall into the first material feed port 154. The feeding device 10 stops feeding the first material and the second material simultaneously.

In alternative embodiments, the first material feed port 154 and the second material feed port 176 may merge at one end to mix the first material and the second material completely before delivery.

In another alternative embodiment, the timing switch 110 includes an audio player. When the timing switch 110 is turned on, the audio player plays music to make operator stay focused so as to improve production efficiency.

In another embodiment, a second material pipe is set above the second container 170. The second material pipe is configured for supplying the second material to the second container 170. A second timing switch is also set on the second material pipe. The second timing switch is configured for controlling the supply of the second material from the second container 150 on a timed basis. The second timing switch further includes a second audio player. When the timing switch is turned on, the second audio player plays music.

Thus, since the timing switch is operated by only one operator, operator errors are avoided even though two different kinds of material are fed simultaneously by the feeding device. The feeding device further includes an audio player on the material pipe; playing music by the audio player could improve production efficiency.

It is believed that the present embodiments and their advantages will be understood from the foregoing description, and it will be apparent that various changes may be made thereto without departing from the spirit and scope of the embodiments or sacrificing all of their material advantages.

What is claimed is:

1. A feeding device, comprising:

a material pipe configured for feeding a first material;

a first container configured for receiving the first material and supplying the first material to a first material feed port;

a second container configured for storing a second material and supplying the second material to a second material feed port; and a constant-length linkage mechanism connected to the first container and the second container;

a first baffler rotatably connected to a bottom side of the first container and functioned as a rotatable bottom base of the first container;

a second baffler arranged at the base of the second container and slidably functioned as a gate at the bottom of the second container; and wherein the first container supplies the first material to the first material feed port, the constant-length linkage mechanism controls the second container to supply the second material to the second material feed port simultaneously.

2. The feeding device of claim 1, wherein the feeding device further comprises a timing switch, the timing switch is arranged on the material pipe and configured for controlling the supply of the first material from the material pipe to the first container on a timed basis.

3. The feeding device of claim 1, wherein the material pipe is above the first container.

4. The feeding device of claim 1, wherein the first container is hollow and open at the top and the bottom.

5. The feeding device of claim 1, wherein the first container is a truncated pyramid-shaped and the first baffler is square, one side of the first baffler is hinged to a bottom side of the first container; the first baffler can rotate about the side of the baffler hinged to the first container.

6. The feeding device of claim 5, wherein when the first baffler rotates to open the bottom of the first container, the first material in the first container falls into the first material feed port.

7. The feeding device of claim 6, wherein the second container is hollow and open at the top and the bottom.

8. The feeding device of claim 1, wherein a slit is arranged on one end of the second baffler, in an initial position the slit is located to one side of the open base of the second container.

9. The feeding device of claim 8, wherein when the second baffler slides along a bracket from initial position, the slit moves to become aligned with the open bottom of the second container, and the second material in the second container falls into the second material feed port through the slit.

10. The feeding device of claim 9, wherein the linkage mechanism is connected to the first baffler and the second baffler, the linkage mechanism drives the second baffler to slide when the first baffler rotates.

11. The feeding device of claim 10, wherein the constant-length linkage mechanism is a connecting rod.

12. The feeding device of claim 7, wherein the feeding device further comprises an automatic reset element, the automatic reset element is configured for resetting the second baffler and the first baffler to an initial position.

13. The feeding device of claim 12, wherein one end of the automatic reset element is connected to the second baffler opposite to the constant-length linkage mechanism; other end of the automatic reset element is resisted by a block.

14. The feeding device of claim 13, wherein the automatic reset element is a spring.

15. The feeding device of claim 2, wherein the timing switch includes an audio player; when the timing switch is turned on, the audio player plays music.

* * * * *